US005342231A

United States Patent [19]

Henns

[11] Patent Number: 5,342,231

[45] Date of Patent: Aug. 30, 1994

[54] SELF ADJUSTING WATER SKI ASSEMBLY

[76] Inventor: John A. Henns, 4611 Sloewood Dr., Tangerine, Fla. 32777

[21] Appl. No.: 57,305

[22] Filed: May 5, 1993

Related U.S. Application Data

[63] Continuation-in-part of Ser. No. 45,551, Apr. 8, 1993.

[51] Int. Cl.[5] ..... B63B 35/81

[52] U.S. Cl. ..... 441/79; 114/127; 114/140

[58] Field of Search ..... 114/127, 140, 162, 167, 114/275, 280, 276, 277, 291; 441/68, 79

[56] References Cited

U.S. PATENT DOCUMENTS 2,547,146 4/1951 Anthony ..... 114/291 X
3,225,728 12/1965 Nomura et al. ..... 114/275
4,037,279 7/1977 Ziebart ..... 9/310 A
4,439,166 3/1984 Maxwell ..... 441/79
4,775,344 10/1988 Anderson ..... 441/68
5,057,045 10/1991 Myers ..... 441/79

*Primary Examiner*—Sherman Basinger
*Attorney, Agent, or Firm*—Steven C. Stewart; James H. Beusse

[57] ABSTRACT

A water ski fin extends through the rear of a water ski. Pivotally connected to a lower portion of the fin is a wing extending substantially perpendicularly from the fin. A linkage is connected to the wing that permits the wing from pivoting until the speed of the fin through the water exceeds a predetermined velocity to pivot and change its angle of attack in response to the speed of the fin through the water exceeding the predetermined velocity.

6 Claims, 3 Drawing Sheets

SELF ADJUSTING WATER SKI ASSEMBLY

This is a continuation-in-part of application Ser. No. 08/045,551, filed Apr. 8, 1993.

BACKGROUND OF THE INVENTION

This invention relates to water sports equipment and more particularly, to finned water skis for controlling the stability during operation.

Conventional water skis include a fin or rudder mounted to the rear on surface portions of the ski. These fins make it easier for the skier to control his skis.

It has been found that slippage of the rear fin can be reduced by providing horizontally extending wings that extend outward from this fin. These wings can act as breaks to help maintain precise control of the ski. Two wings are typically mounted on the fins at fixed angles.

Angular positions can significantly effect the performance of the skis. Examples of a fin having a fixed manually adjustable angular position is disclosed in U.S. Pat. No. 4,439,166, which is hereby incorporated by reference.

Ideally, it is desirable to maintain a variable angle of the wing with respect to the speed of water past the wing. A wing at a fixed angle can cause unwanted drag and a degradation of ski performance.

To optimize ski performance, it is desirable to change the angle of the wing as the ski accelerates and decelerates. Devices have attempted to control this wing angle, such as the brake described in U.S. Pat. No. 5,057,045. This brake requires the operator to adjust the wing angle with his or her foot. However, the operator is not always able to respond quickly enough to change the angle of the wing thereby degrading ski performance.

SUMMARY OF THE INVENTION

An object of this invention is to provide an improved water ski fin.

Another object of this invention is to increase the performance of the ski by changing the angle of the wing on a ski fin with respect to changes in the velocity of water.

Another object of this invention is to maintain the angle of the wing in a fixed position on the fin until the speed of the fin reaches a predetermined velocity.

These and other objects are provided with a self adjusting water ski assembly. The assembly includes a water ski with a substantially planer lower surface and a fin connected to the ski and extending substantially perpendicularly away from the skis lower surface. A wing is pivotally connected to the fin and extended substantially perpendicularly outward from either side of the fin. The wing also has a substantially planer surface. A linkage is connected to the wing that permits the wing to rotate about the pivot in response to the speed of the fin through the water. The linkage prevents the wing from rotating about the pivot until the speed of the fin exceeds a predetermined velocity. By controlling the angle of the wing with respect to water velocity, better control, stability, acceleration and braking of the water ski may be obtained.

BRIEF DESCRIPTION OF THE PREFERRED EMBODIMENTS

Figure 1:
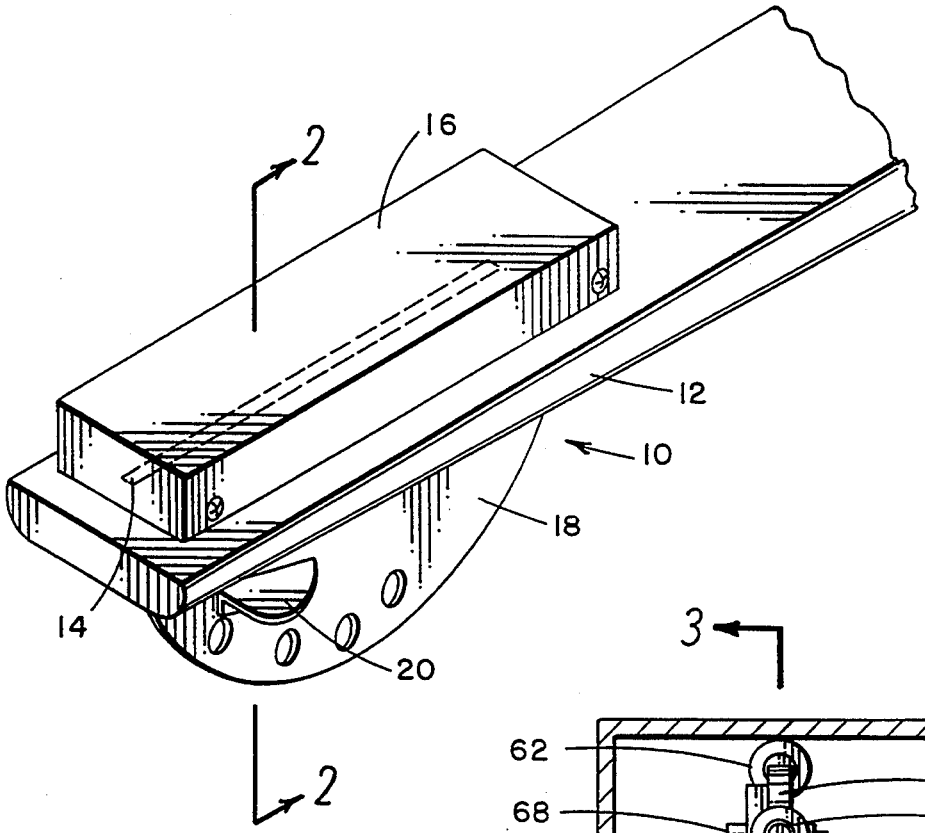
FIG. 1 is a perspective view of the invention mounted on a rear portion of a water ski.

Referring now to the drawings and detail where in like reference numerals have been used throughout the various figures to designate like elements, there is shown in FIG. 1 a water ski fin and adjustable wing assembly constructed in accordance with the principles of the present invention designated generally as assembly 10. Assembly 10 is shown mounted on rear end of ski 12. The ski 12 includes an elongated slot 14 therein which passes entirely through the ski adjacent to center line thereof. The ski 12 is, per se, conventional and is pulled through the water conventionally. Accordingly, only a portion thereof has been shown in the drawings.

Assembly 10 is comprised essentially of four principal parts; a housing or mounting means 16, fin 18, wings 20 and 21 (FIG. 2) and linkage 93. As shown and more clearly in FIGS. 2–4, the entire housing or mounting means 16 is located on the upper surface of ski 12. The fin 18 extends downwardly through slot 14 perpendicular to housing 16 and ski 12. Wings 20 and 21 are pivotally connected to and extend perpendicularly outward from either side of the surface of fin 18. Linkage 93 permits the wings 20 and 21 to pivotally rotate in response to the speed of the fin 18 through the water exceeding a predetermined velocity. Linkage 93 also prevents wings 20 and 21 from rotating until the speed of the fin 18 through the water exceeds the predetermined velocity.

Within mounting means is a pair of L-shaped brackets 19 and 22, which connect with screws 26, 27 and 28 through brackets 19 and 22 and are held in place with nuts 30–32, respectively. The fin 18 is sandwiched between brackets 19 and 22 and is held in place by turning screws 26–28.

Figure 2:
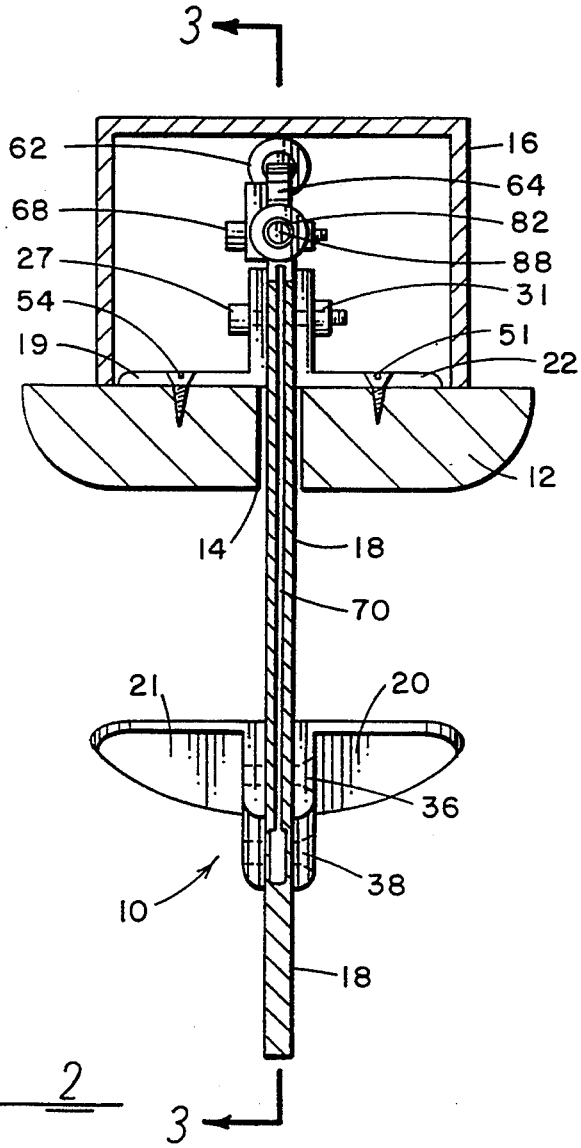
FIG. 2 is a rear view of the invention along line 2—2 of FIG. 1.
Figure 3:
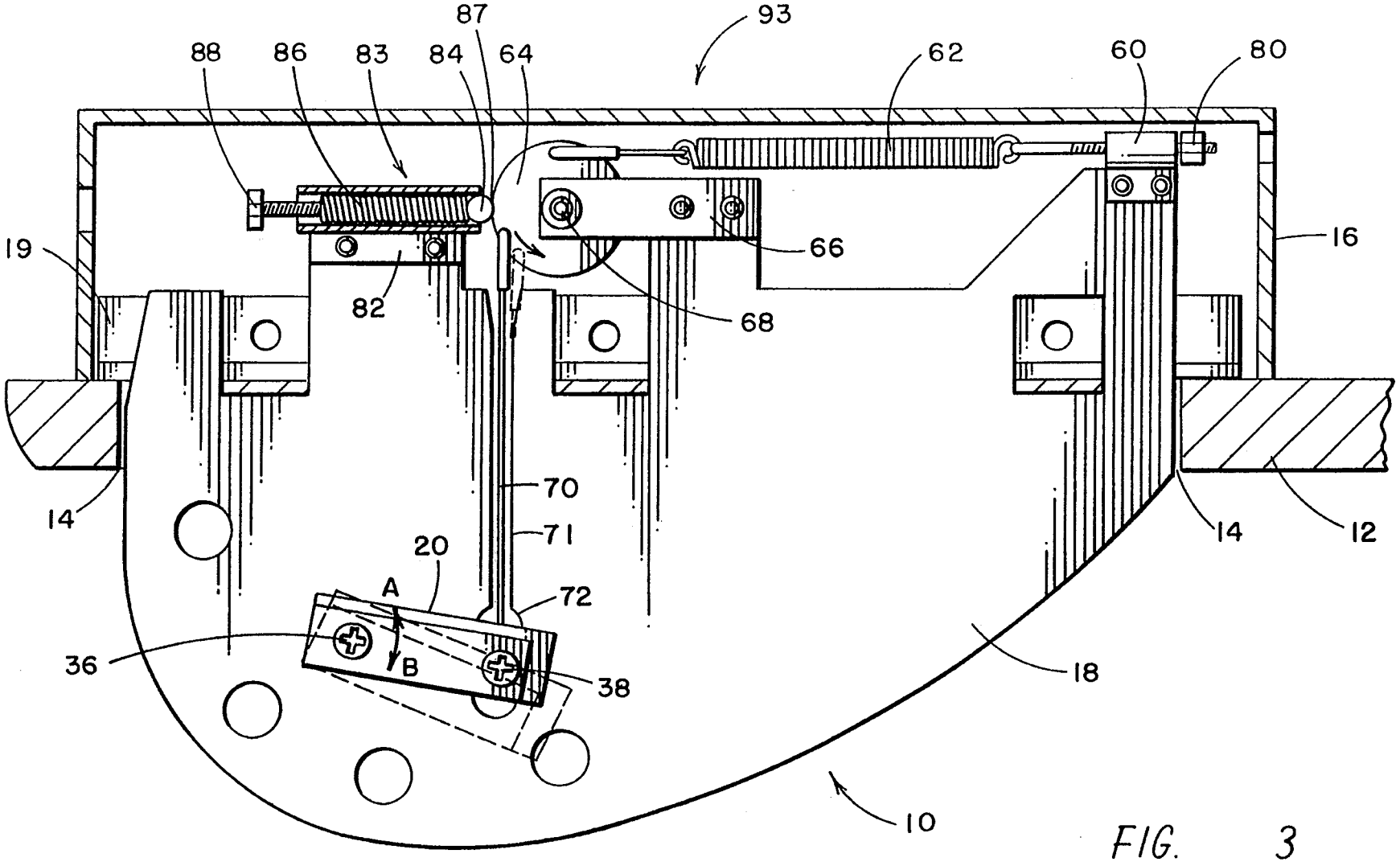
FIG. 3 is a side view of the invention along line 3—3 of FIG. 2.
Figure 4:
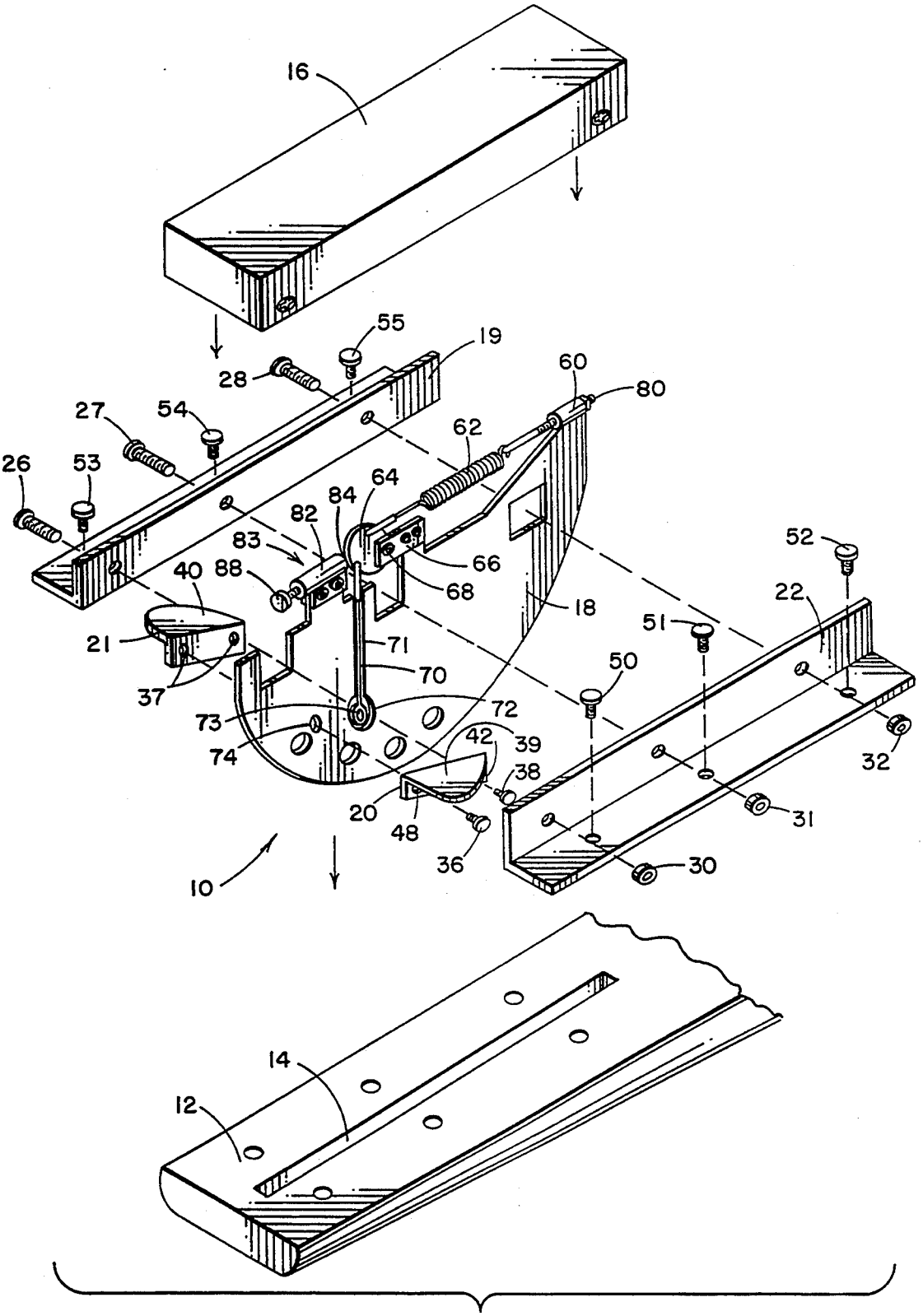
FIG. 4 is an exploded view of the invention shown in FIG. 1.

Referring to FIGS. 2–4, right wing 20 and left wing 21 are pivotally connected with pivot or screw 36 to a substantially lower rear portion of fin 18. Wings 20 and 21 are preferably L-shaped brackets having a parabolic planer flat top surface 39 and 40, respectively. Wing 20 has an aperture 42 through which pin or screw 38 is inserted and has an aperture 48 through which screw 36 is inserted therethrough. Screws 36 and 38, respectively, extend through fin 18 and attach through threaded apertures 37 and 39 in wing 21. Brackets 19 and 22 are connected with screws 50–55 to the top surface of ski 12.

Attached to the top portion of fin 18 is linkage 93 which includes spring 62, detent cam 64, rod 70 and detent assembly 83. Connected to a forward top edge of fin 18 is plate 60. Spring 62 is connected between plate 60 and rotating cam 64. Although spring 62 is shown, any tension device may be used. Rotating detent cam 64 is pivotally connected to a center portion of a bracket 66 and maintained on a center position of fin 18 with pin 68. Extending downward from cam 64 through a slit 71 in fin 18 is rod 70. Rod 70 is connected at one end to detent cam 64 and contains an eyelet 73 at its other end that extends within an aperture 72 disposed forward on fin 18 from aperture 74. Screw 38 extends through eyelet 73. Wings 20 and 21 and rod 70 pivot together about screw 36 on fin 18 with the expansion and contraction of spring 62.

Referring to FIGS. 2 and 3, detent assembly 83 includes casing 82 enclosing longitudinal spring 86. Spring 86 is connected at one end to detent ball 84 and is attached at its other end to adjustable screw 88. Screw 88 is threadably connected to casing 82. Screw 88 is turned to adjust spring 86.

Detent ball 84 is positioned between casing 82 and detent cam 64. Detent ball 84 engages with a detent 87 in cam 64 to prevent cam 64 from rotating. Detent ball 84 disengages with cam 64 when a downward force of rod 70 reaches a predetermined level to permit cam to rotate. This downward force is reached when the speed of the fin 18 through the water typically exceeds 45 mph. Screw 88 can be adjusted to change the tension of spring 86 thereby changing the speed of the fin 18 which causes detent to disengage.

During operation of the fin 18, at slow ski speeds spring 62 is in a contracted position (position A) and detent ball 84 engages with cam 64. When ball engages cam 64, the angle of the top surface of wings 20 and 21 is at about a 1° angle with respect to the bottom surface of ski 12.

As the velocity of the ski and fin 18 through the water increases, water is directed by ski 12 over wings 20 and 21. This water being directed over wings 20 and 21 causes a downward force on rod 70 forcing detent ball 84 to disengage with cam 64 when the speed of the water makes a predetermined velocity. Preferably this velocity is set to between 30 mph and 75 mph. As a result of the disengagement, spring 62 expands and the angle of wings 20 and 21 approach 20° (position B) with respect to horizontal. This creates a variable rearward drag force that is a function of the wing angle, spring force, and water velocity.

As the ski slows down and the velocity of the fin 18 through the water decreases to below the predetermined velocity, the downward force on wing 20 and 21 decreases allowing spring 62 to reset cam to position A. In position A, cam 64 re-engages with ball 84. The predetermined velocity at which ball 84 re-engages with cam 64 is less than 30 mph and is set by adjusting the tension of screw 80. Linkage 93 prevents wings 20 and 21 from rotating about pivot 36 when the speed of the fin 18 through the water falls below the predetermined velocity after fin 18 exceeds the predetermined velocity. The position of fin 18 causes a variable drag that creates enhanced ski performance and control.

Preferred angle at which wings 20 and 21 rotates about screw 36 is between 0°–20° although other angles may be applicable, depending on the application and use of the skier. By using detent 84, the cam 64 does not turn until the speed of the ski through the water reaches the predetermined velocity. The amount that wings 20 and 21 rotate with respect to the water velocity may be linear as a function of the speed or may be non-linear depending on the curvature of cam 64. Accordingly, it may require a large increase in velocity to effect the angle of the surface of wings 20 and 21 with respect to the bottom surface of ski 12. The amount of force required to turn cam 64 may be changed by rotating adjustable screw 88.

This concludes the description of the preferred embodiments. A reading by those skilled in the art will bring to mind various changes without departing from the spirit and scope of the invention. It is intended, however, that the invention only be limited by the following appended claims.

What is claimed is:

1. An automatically adjusting water ski fin and wing assembly comprising:

a fin having one end connected to a rear portion of a water ski and having another end extending away from a lower surface of the rear portion of the water ski;

a wing extending outward from either side of said fin;

a pivot pin connecting said wing to said fin; and means for permitting said wing to rotate about said pivot in response to the speed of the fin through the water, and for preventing said wing from rotating about said pivot in a first direction until the speed of the fin through the water exceeds a first predetermined velocity, said permitting means preventing said wing from rotating about said pivot in a second direction opposite said first direction until the speed of the fin through the water falls below a second predetermined velocity, wherein said second predetermined velocity is less than the first predetermined velocity.

2. The assembly as recited in claim 1 wherein said permitting means includes means having a rotatable screw for changing the first predetermined velocity at which the fin rotates.

3. An automatically adjusting water ski fin and wing assembly comprising:

a fin having one end connected to a rear portion of a water ski and having another end extending away from a lower surface of the rear portion of the water ski;

a wing extending outward from either side of said fin;

a pivot pin connecting said wing to said fin; and means for permitting said wing to rotate about said pivot in response to the speed of the fin through the water, and for preventing said wing from rotating about said pivot until the speed of the fin through the water exceeds a predetermined velocity, said preventing means including a rotating cam having a detente on its outer perimeter, and a spring connected to a detente ball that engages with said detente in the rotating cam when the speed of the fin through the water is below the predetermined velocity and wherein said detente ball disengages with the detente in the cam when the speed of the fin through the water exceeds the predetermined velocity.

4. A self-adjusting water ski assembly comprising:

a water ski having a substantially planer lower surface and a longitudinally oriented slot;

a fin connected to said ski and extending through said slot substantially perpendicularly away from the lower surface of the ski;

a wing pivotally connected to a substantially lower rear portion of said fin and extending substantially perpendicularly outward from either side of said fin, said wing having a substantially planer surface; and means for permitting said wing to pivotally rotate on said fin in response to the speed of the fin through the water exceeding a predetermined velocity and for preventing said wing from rotating about said pivot until the speed of the fin through the water exceeds said predetermined velocity.

5. A self-adjusting water ski assembly comprising:

a water ski having a substantially planer lower surface;

a fin connected to said ski and extending substantially perpendicularly away from the lower surface of the ski;

a wing connected with a pivot to said fin and extending substantially perpendicularly outward from either side of said fin, said wing having a substantially planer top surface;

a rotating cam having a detent in its outer perimeter and being connected to a top portion of said fin, said cam connected to a forward portion of said fin with a first spring and being connected to said wing with a rod;

a detent ball being connected with a second spring to a rear portion of the fin and engaging with the detent in the cam in its initial position;

said wing being positioned on said fin to rotate about said pivot caused by an increasing downward force on said rod as a function of the velocity of the fin through the water increasing; and said second spring tension being set such that said detent ball disengages with said cam when the downward force on the rod reaches a predetermined level thereby preventing said wing from rotating about said pivot until the speed of the fin through the water exceeds said predetermined velocity.

6. The assembly as recited in claim 5 wherein the second spring is connected to a screw that varies the tension of said second spring to change the predetermined velocity at which said detent ball disengages with said cam.

* * * * *